US005701817A

United States Patent [19]

Thünker et al.

[11] Patent Number: 5,701,817

[45] Date of Patent: Dec. 30, 1997

[54] APPARATUS FOR ADJUSTING THE MOVEMENT OF A ROLLER IN A PRINTING PRESS

[75] Inventors: Norbert Thünker, Hirschberg; Rudi Junghans, Wilhelmsfeld, both of Germany

[73] Assignee: Heidelberger Druckmaschinen Aktiengesellschaft, Heidelberg, Germany

[21] Appl. No.: 549,193

[22] Filed: Oct. 6, 1995

[30] Foreign Application Priority Data

Oct. 8, 1994 [DE] Germany ..... 44 35 991.8

[51] Int. Cl.[6] ..... B41F 31/14

[52] U.S. Cl. ..... 101/350; 101/484; 101/DIG. 38

[58] Field of Search ..... 101/DIG. 38, 348, 101/349, 350, 351, 352, 483, 485, 363, 364, 207, 208, 209, 210

[56] References Cited

U.S. PATENT DOCUMENTS

| | | | |
|---|---|---|---|
| 4,332,195 | 6/1982 | Mizumura | 101/349 |
| 4,513,663 | 4/1985 | Hummel et al. | 101/349 |
| 5,081,926 | 1/1992 | Rodi | 101/211 |
| 5,170,711 | 12/1992 | Maier et al. . | |

FOREIGN PATENT DOCUMENTS

| | | |
|---|---|---|
| 0545237 | 6/1993 | European Pat. Off. . |
| 4004056 | 8/1991 | Germany . |
| 4140048 | 6/1993 | Germany . |

OTHER PUBLICATIONS

"Vorgange im Walzenspalt unter Berucksichtigung der seitlichen Verreibung im Farbwerk einer Offsetdruckmaschine", Papier und Fruck 29, 1980, pp. 5–8.

*Primary Examiner*—J. Reed Fisher

*Attorney, Agent, or Firm*—Nils H. Ljungman and Associates

[57] ABSTRACT

A method and an apparatus for displacing at least one roller of an offset rotary printing press. An arrangement is provided for affording the displaceability of at least one roller in a highly versatile and adaptable manner. Displacement of the at least one roller in question can be undertaken in such a manner as to markedly facilitate the operation of a printing press.

20 Claims, 8 Drawing Sheets

APPARATUS FOR ADJUSTING THE MOVEMENT OF A ROLLER IN A PRINTING PRESS

BACKGROUND OF THE INVENTION

1. Field of the Invention

Generally, the present invention relates to apparatus for adjusting the movement or displacement of at least one roller of a printing press, as well as apparatus for performing the method.

2. Background Information

Generally, a printing unit of a printing press will have disposed therein a plurality of rollers mounted for rotation within the printing unit. In order for a successful printing run to be undertaken, it is generally important that these rollers be able to move in a substantially unhindered manner.

It has often been the case that restricted movement of rollers can potentially provide detrimental effects in operating a printing unit of a printing press. Although the restrictions on the movement of a roller could possibly arise from any number of factors, it is generally recognized that greater freedom of movement, for the rollers, will provide markedly improved printing results.

Typically, the rollers of a printing unit are arranged in a chain, usually extending from the upper portion of the printing unit to the region of the plate cylinder and blanket cylinder. Various possible arrangements are feasible with regard to such chains of rollers, and in many instances, a chain of rollers can involve a relatively complicated structure. On the other hand, chains of rollers having a simpler pattern have been used.

Typically, one or more of the rollers of a printing unit will be mounted only for rotational movement. Thus, such rollers will typically extend between the sides of the frame of the printing unit in question, and will usually be mounted in a simple rotational bearing in the sides of the printing unit frame. Accordingly, such rotational bearings may, for the most part, be considered to be fixed, involving no more complicated a structure than that which is necessary to simply hold portions or extensions of a roller in place, only allowing such portions or extensions of a roller to rotate. As a result, rollers mounted in such a manner will generally be hindered from moving in a translational manner, that is, in a manner that would effectively involve movement of the rotational axis of the roller in question. Such rollers also will typically be hindered from being displaced axially, that is, in a linear direction that is parallel to the rotational axis of the roller.

On the other hand, it is known to permit a selected roller or rollers of a printing unit to be movable not only in a rotational direction but also in an axial direction. Such axial movement can also be permitted while the roller is rotating, thereby allowing the roller to undergo a simultaneous rotational and axial displacement during operation of the printing unit. Depending on the positioning of such a roller relative to other rollers in the printing unit, such a roller may be termed a "distributor roller". Distributor rollers, per se, are quite well-known and may involve any of a wide variety of arrangements for affording axial displacement of the same simultaneously with rotational displacement.

On printing forms which have different surface coverages in the individual ink zones, one problem is that the desired thickness of the ink in the zones which have only a very low ink coverage tends to be overrun by the neighboring zones which have a higher ink coverage, and the result is an undesirable equalization of the thicknesses of the ink layers. The same problem occurs if, while the printing machine is running, brief interruptions in printing are necessary, during which the paper feed and ink feed are briefly shut off and the inking unit continues to rotate. In these situations, the result is an ink profile across the width of the inking unit which is modified by the lateral spreading of the ink by rubbing, to the extent that the ink profile achieved on the printing plate hardly has anything to do with the actual ink requirement.

To correct these problems, German Patent No. 41 40 048 A1 teaches that the drive of a distributor roller can be interrupted by means of a clutch, so that the periodic axial motion of the distributor roller can be stopped. The disadvantage of this known solution is that it presents problems in terms of the re-engagement of the distributing rollers in the correct phase when printing resumes, e.g. once the interruption in the printing is over and the paper feed is resumed. If there are several distributing rollers in an inking unit, these distributing rollers normally do not tend to execute their axial stroke in synchronization, which means that they require quite a complex control system to re-establish the previously specified axial stroke. A modification of the axial stroke movement of the individual distributing rollers would likely have a direct effect on the result of the printing, and would lead to an undesirable change in the ink profile achieved.

OBJECT OF THE INVENTION

Starting from the situation described above, an object of the present invention is to keep the lateral flow of ink in the inking unit as constant as is necessary for the correct inking of the printing form, even when the specified thicknesses of ink are very different or when there are interruptions in the printing, without the occurrence of problems such as the lateral spreading of the ink by rubbing.

SUMMARY OF THE INVENTION

A method for resetting an inking unit, contemplated in accordance with at least one preferred embodiment of the present invention, is characterized by the fact that, when the printed items being produced have a relatively uniform ink profile at right angles to the direction of printing, the distributing rollers are set to the respective specified full stroke, and that when printed items are being produced which have an ink profile which differs significantly in the direction at right angles to the direction of printing, or when there is a brief interruption of the printing, the stroke of at least the first distributing roller which follows the ink duct roller is reset to a lower value near 0, while the printing unit continues to run. The distributing roller reset in this manner can continue to execute a small stroke, e.g. of about 1 mm, so that there is no change in the phase position of the lateral motion of the distributing roller. Furthermore, it is not generally necessary, when the printing unit is running, to engage the drive for the lateral stroke, so that no rotational fluctuations can occur in the printing unit. Thus, there is essentially no need to make any readjustments to the ink control and delivery system. An additional advantage is that the operator of the printing machine can set each position of the distributing roller stroke for the normal printing tasks.

An apparatus for the realization of the method described above is characterized by the fact that the axial stroke of the distributing roller is realized by means of an eccentrically offset roller which is mounted on the axle end of the distributing roller, and which can be moved between two parallel tread or running surfaces which are mounted in parallel on the machine side frame, that the roller has a rotary drive motion, that its eccentric location moves the distributing rollers back and forth axially, and that the distance of at least one of the two parallel tread surfaces with respect to the opposite tread surface can be increased. As a result of the greater distance between the two tread surfaces, the eccentrically mounted roller rotates over the greatest part of its rotational movement without transmitting a stroke to the respective distributing roller. Only in the vicinity of its turnaround point does the roller encounter one of the two tread surfaces, so that as a function of the distance, an axial stroke of only about 1 mm, for example, may be executed. The distance between the two tread surfaces is thereby determined by the eccentricity of the axle end of the roller with respect to the rotary drive, and can be set individually.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

In summary, one aspect of the invention resides broadly in a printing press comprising: a frame; a plate cylinder being rotatably mounted with respect to the frame; an ink reservoir for holding a supply of ink; an inking mechanism for transferring the ink between the ink reservoir and the plate cylinder during operation of the printing press; the inking mechanism comprising a plurality of inking rollers for transferring ink from the ink reservoir to the plate cylinder; a blanket cylinder being rotatably mounted with respect to the frame and having means for being engaged with the plate cylinder during operation of the printing press; a distributor roller for being engaged with at least one of the inking rollers during operation of the printing press; the distributor roller having a rotational axis and being mounted, with respect to the frame, for rotation about the rotational axis; means for displacing the distributor roller, simultaneously with the rotation of the distributor roller, in a direction substantially parallel to the rotational axis of the distributor roller, to laterally oscillate the distributor roller over a determinable lateral stroke; means for varying the determinable lateral stroke of the distributor roller during the running of the printing press and rotation of the distributor roller; and the varying means comprising means for varying the stroke of the distributor roller over a substantial portion of a maximum stroke of the distributor roller during the running of the printing press and rotation of the distributor roller by changing the stroke of the distributor roller from a minimal stroke to a maximum stroke.

Another aspect of the invention resides broadly in a method for producing a first ink zone profile corresponding to a first printing job in at least one printing unit of a rotary printing press and for changing from the first ink zone profile, corresponding to the first printing job, to a second ink zone profile corresponding to a second printing job, the second printing job being carried out substantially immediately subsequent to the first printing job, the printing unit comprising: a frame, a plate cylinder being rotatably mounted with respect to the frame, an ink reservoir for holding a supply of ink, an inking mechanism for transferring the ink between the ink reservoir and the plate cylinder during operation of the printing press, an adjustable ink zone metering arrangement, the individually adjustable ink zone metering arrangement having means for defining ink zones of the at least one printing unit, the ink zones being defined one after the other in a direction substantially transverse to the direction in which printing takes place, the inking mechanism comprising a plurality of inking rollers for transferring ink from the ink reservoir to the plate cylinder, a blanket cylinder being rotatably mounted with respect to the frame and having means for being engaged with the plate cylinder during operation of the printing press, at least one distributor roller for being engaged with at least one of the inking rollers during operation of the printing press, each of the at least one distributor roller having a rotational axis and being mounted, with respect to the frame, for rotation about its rotational axis; the printing press further comprising: means for displacing each of the at least distributor roller, simultaneously with the rotation of the at least one distributor roller, in a direction substantially parallel to the rotational axis of each of the at least one distributor roller, to laterally oscillate the at least one distributor roller over a determinable lateral stroke; means for varying the determinable lateral stroke of the at least one distributor roller during the running of the printing press and rotation of the at least one distributor roller; and the varying means comprising means for changing the stroke of the at least one distributor roller over a substantial portion of a maximum stroke of the at least one distributor roller during the running of the printing press and rotation of the at least one distributor roller; the method comprising the steps of: setting a first ink zone profile at the adjustable ink zone metering arrangement; producing the first ink zone profile by initiating operation of: the plate cylinder; the at least one distributor roller; and the plurality of inking rollers; by transferring ink from the ink reservoir to the plate cylinder via a route of travel which extends: from the ink reservoir through the adjustable ink zone metering arrangement; thereafter to the plurality of inking rollers and the distributor roller; and thereafter to the plate cylinder; printing the first printing job; thereafter continuing uninterrupted rotational movement of at least: the at least one distributor roller; and the plurality of inking rollers; and simultaneously changing to the second ink zone profile, corresponding to the second printing job, by adjusting the adjustable ink zone metering arrangement at least at one ink zone; varying, with the varying means, the determinable lateral stroke of the distributor roller in relation to the adjusting of the adjustable ink zone metering arrangement, the varying being performed over a substantial portion of a maximum stroke of the at least one distributor roller; the varying step being performed during the step of continuing uninterrupted rotational movement of at least the distributor roller and the plurality of inking rollers; further continuing operation of at least: the at least one distributor roller; and the plurality of inking rollers; until the second ink zone profile is established; and printing the second printing job.

BRIEF DESCRIPTION OF THE DRAWINGS

One embodiment of the invention is described in greater detail below and is schematically illustrated in the accompanying drawings.

DESCRIPTION OF THE PREFERRED EMBODIMENTS

Figure 1:
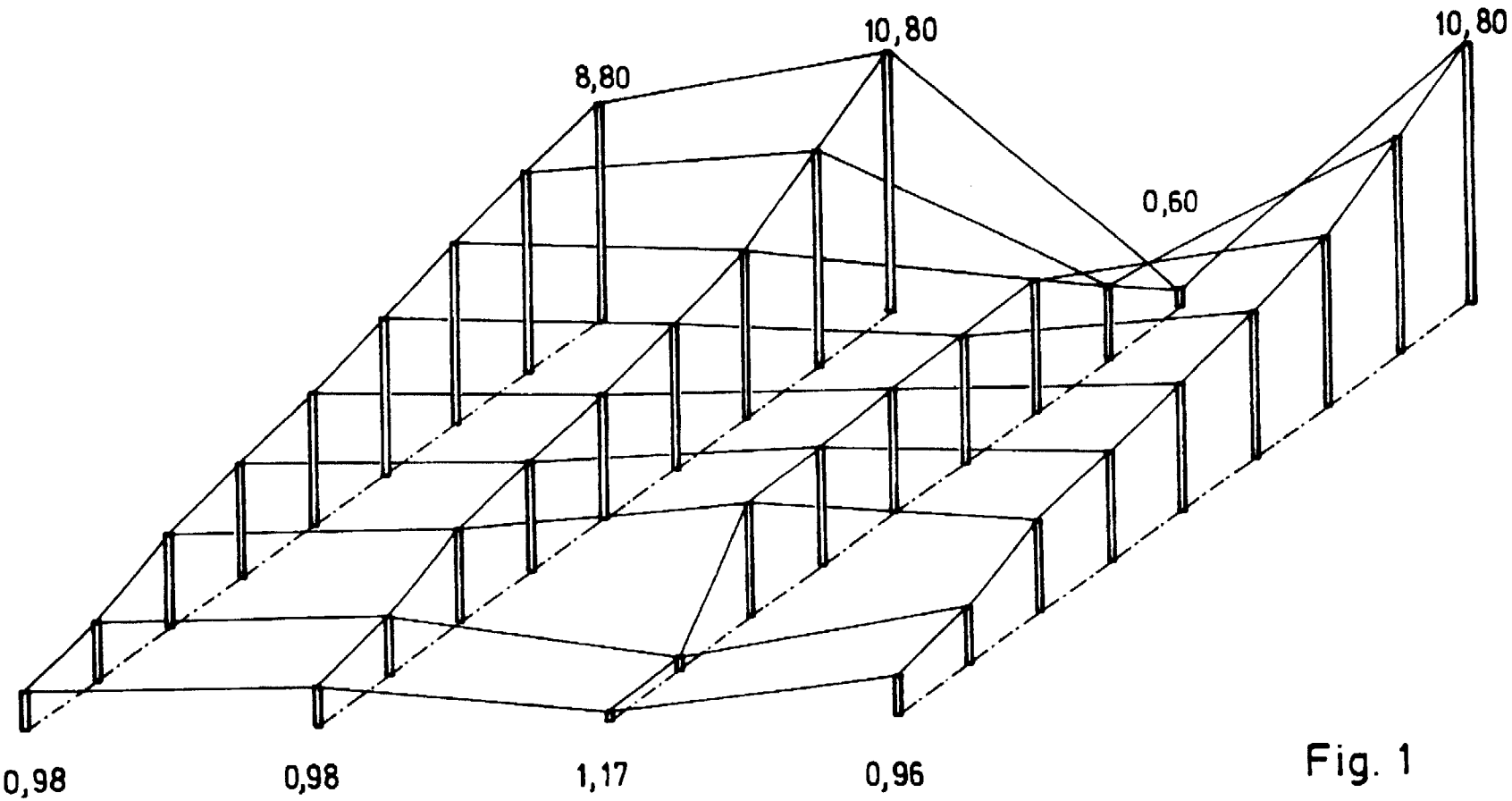
FIG. 1 is a diagram of topical ink distribution in different zones.

FIG. 1 is a diagram of ink distribution over four arbitrary zones, whereby the individual zones on the ink ductor are set to the values 8.80, 10.80, 0.60 and 10.80, since the ink coverages required in the individual zones are very different. As a result of the separation of the ink and the lateral spreading of the ink by rubbing in the inking unit, there can essentially be an ink profile on the printed sheet of about 0.98, 0.98, 1.17 and 0.96, respectively. In known inking units, the value of 1.17 in the zone which requires the lowest ink feed of 0.60 particularly tends to result on account of the lateral spreading of ink by rubbing on the upper distributing rollers, so that the thickness of the ink layer of 1.17 in no way corresponds to the amount of ink actually required in this zone. This phenomenon can occur during the normal progress of the printing process, but it also can occur in particular if the printing is briefly interrupted, for example, so that when the inking rollers are once again applied to the printing plate, a longer break-in phase is required, with the corresponding waste of paper, to re-establish the thickness of the ink layer which corresponds to the amount of ink required in the individual zones.

Figure 2:
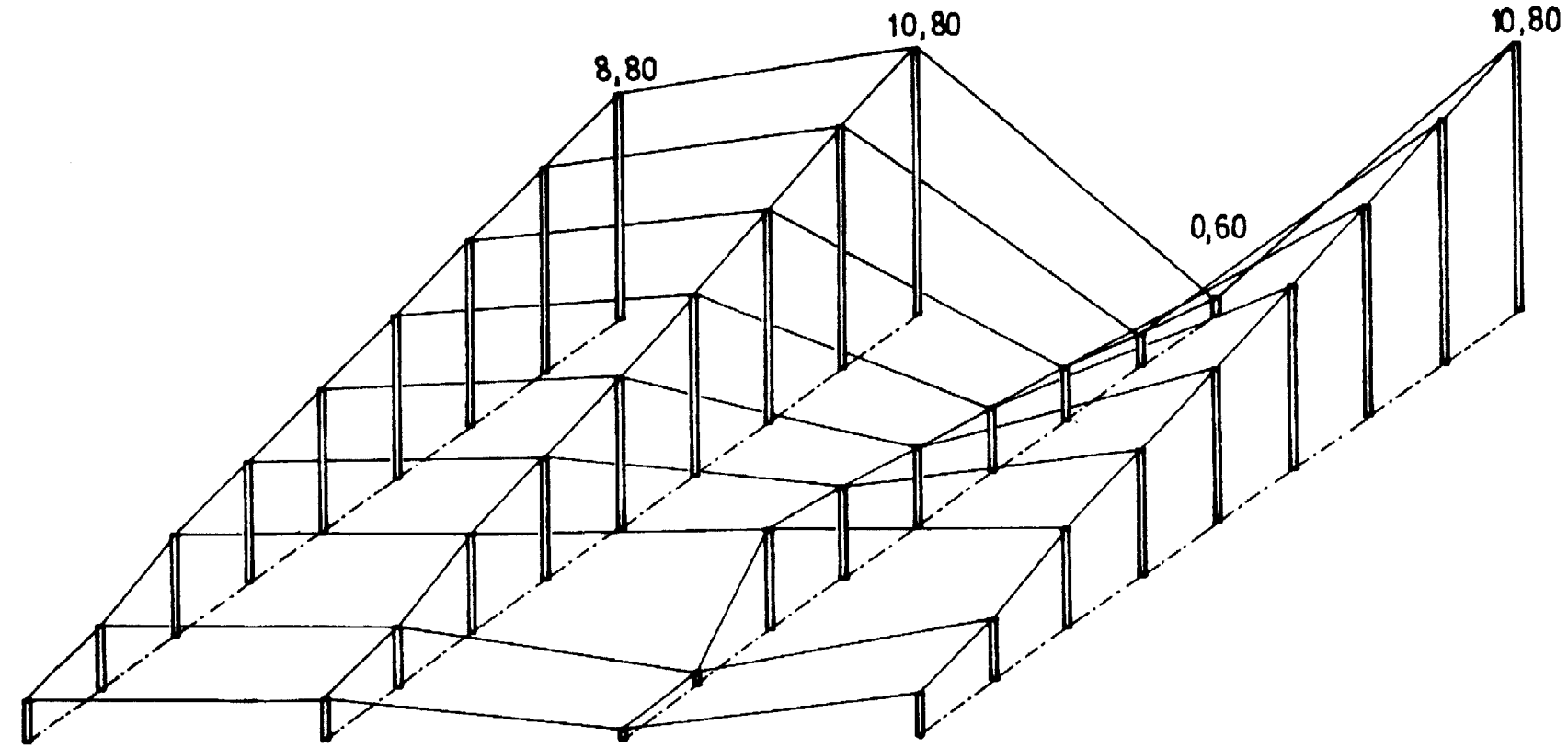
FIG. 2 is a diagram of ink distribution contemplated by the present invention.

In FIG. 2, the individual ink zones on the ink ductor have also been set to the values 8.80, 10.80, 0.60 and 10.80. However, in this diagram, the stroke of at least the first distributing roller after the ink ductor roller is set to a low value near 0. Consequently, the zone with the low value 0.60 does not receive so much ink from the two neighboring zones which have the values 10.80, so that in this zone, only an ink layer thickness having the value 1.02 is achieved on the printed sheet. Thus, instead of excess inking taking place, there is essentially a layer thickness at that point on the grid, the layer thickness making it possible to achieve the values required for printing after only a few sheets.

Figure 3:
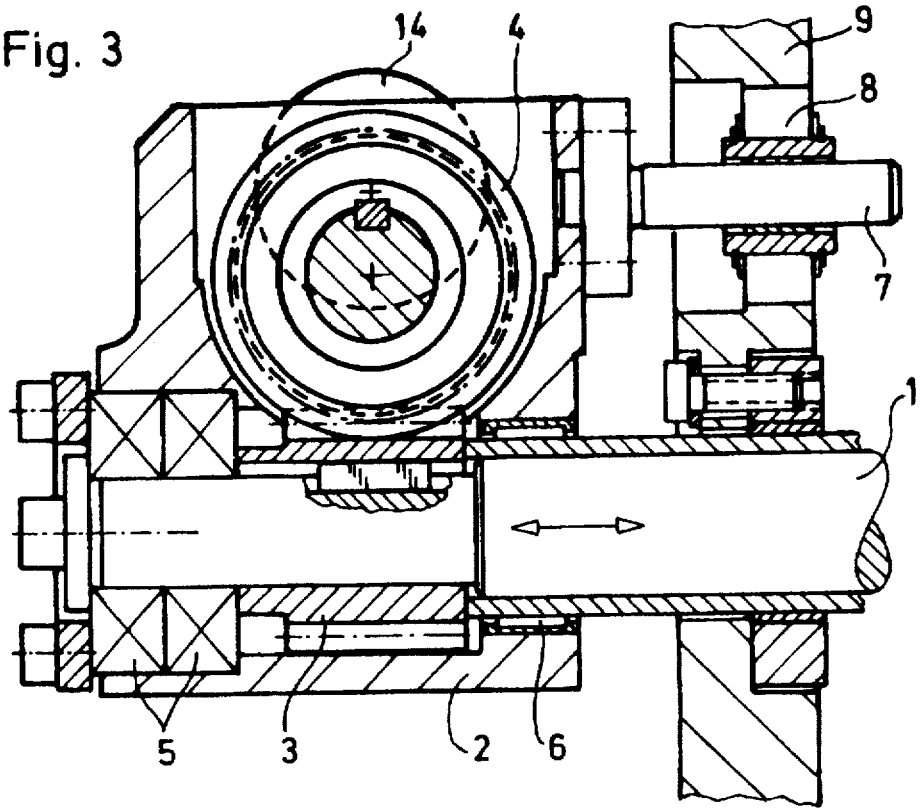
FIG. 3 is a longitudinal section through a transmission to drive a roller.

Turning now to FIG. 3, the stub axle 1 of a distributing roller (not shown) of an inking unit, in a transmission housing 2, there is preferably a worm 3 and a worm gear 4, whereby the worm 3 is fastened to the stub axle 1 of the distributing roller. The transmission housing 2 is preferably mounted by means of a ball bearing 5 and a needle bearing 6 on the stub axle 1 of the distributing roller, and moves back and forth with the stub axle 1 of the distributing roller.

To prevent the transmission housing 2 from rotating along with stub axle 1, there is preferably, parallel to the stub axle 1, a supporting pin 7 which is mounted laterally on the transmission housing 2, which supporting pin 7 moves back and forth in a bearing 8 which is fastened in a bearing plate 9.

Figure 4:
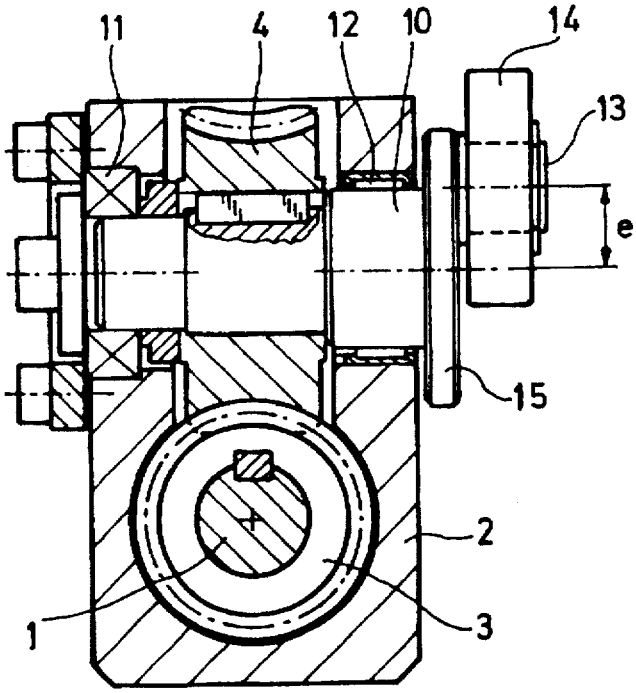
FIG. 4 is a cross section through the transmission.

In FIG. 4, the transmission housing 2 is shown in a cross section, with the worm gear 4 mounted on a crank pin 10. The crank pin 10 is preferably rotationally mounted in the transmission housing 2 by means of a ball bearing 11 and a needle bearing 12. On one end, the crank pin 10 preferably supports a roller 14 which is mounted on a roller pin 13. In this embodiment, the roller pin 13 can be movably mounted on a flange 15 so that the magnitude of the eccentricity e can be adjusted. As a result, the lateral stroke of the distributing roller, which preferably corresponds to twice the value of e, can be adapted to meet the requirements of the particular printing operation.

Figure 5:
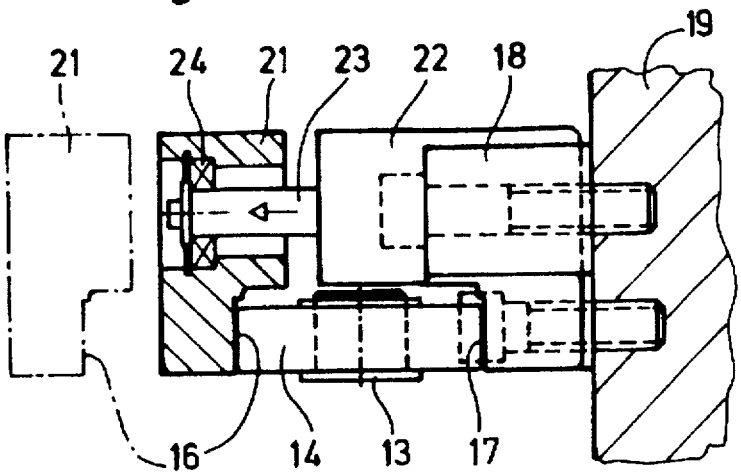
FIG. 5 shows the roller between two tread surfaces.

FIG. 5 shows the roller 14 between two tread surfaces 16, 17 which are oriented parallel to one another, of which the tread surface 17 is preferably provided on a carrier 18 which is fastened to the machine side frame 19. Fastened in the carrier 18 there are preferably two bearing pins 20 (see FIG. 6), on which a slide body 21 can be displaced axially, and on which there is the second tread surface 16. By displacing the slide body 21, the distance between the two tread surfaces 16 and 17 can be increased by an amount which corresponds to the diameter of the roller 14, until it reaches the position indicated by the broken lines. The displacement of the slide body 21 can be accomplished, for example, by means of an actuator motor 22 which is fastened in the carrier 18. A motor pin 23, which is preferably connected by means of a ball bearing 24 to the slide body 21, can be moved to the left in the direction indicated by the arrow until the slide body 21 assumes the position indicated by the broken lines (see FIGS. 5 and 6).

Figure 7:
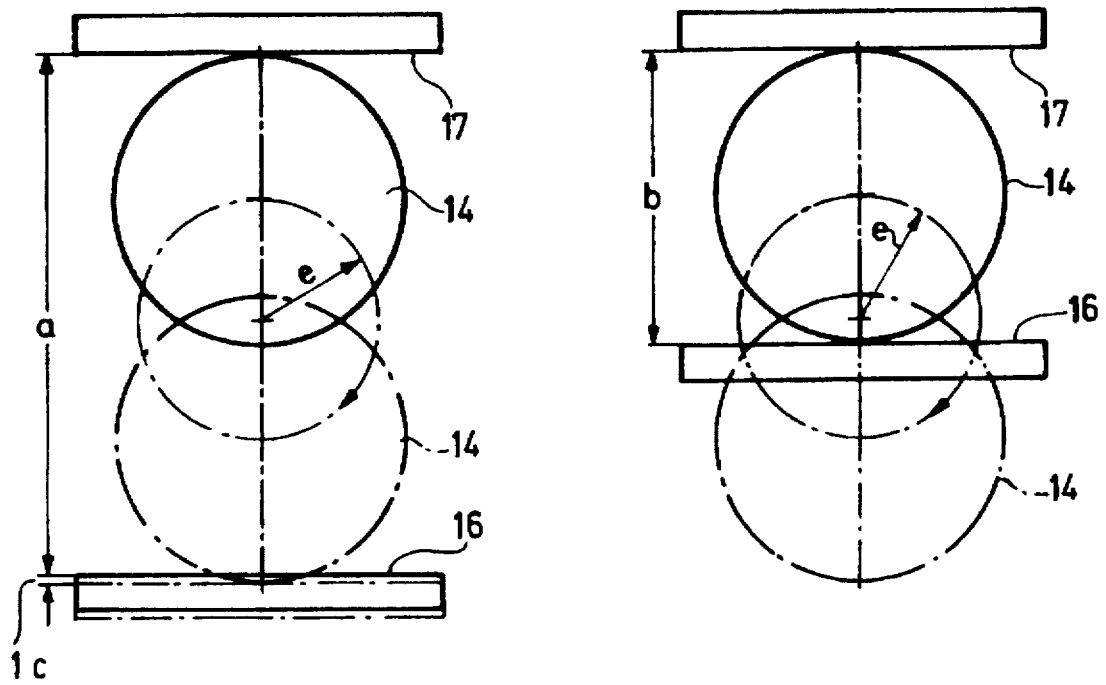
FIG. 7 is a diagram of the two tread surfaces, in the deactivated and activated positions.

FIG. 7 is a schematic illustration of the increased distance between the two tread surfaces 16, 17, whereby this distance corresponds to the distance a. The value a can, for example, be twice the value of the eccentricity e, plus one times the diameter of the roller 14, minus a distance c. The distance c can, for a possible embodiment, be 1 mm. In this case, the axial stroke of the distributing roller would be 1 mm as a result. This stroke distance results from the fact that the roller 14 is displaced by 1 mm from its upper position, shown in solid lines, after a rotational motion of 180 degrees, into the position indicated by the broken lines with respect to the tread surface 16 shown in solid lines, so that the distributing roller executes a corresponding stroke movement.

In the schematic diagram on the right in FIG. 7, the two tread surfaces 16 and 17 have been pushed together to a distance b, which corresponds to the diameter of the roller 14. When a rotational movement occurs, the roller 14, after it has moved 180 degrees, therefore displaces the distributor roller so that it executes a stroke of twice e. In this position of the tread surfaces 16, 17, thus the full stroke of the crank-mounted roller 14 is transmitted to the distributing rollers, while when the increased distance a is present between the treads 16, 17 as shown in the diagram on the left, the stroke length is reduced, e.g. to 1 mm. Consequently, the lateral spreading of the ink by rubbing is reduced to a value near 0, so that essentially no unintentional equalization of ink takes place between zones in which a great deal of ink is required and zones in which a lower amount of ink is required.

Figure 6:
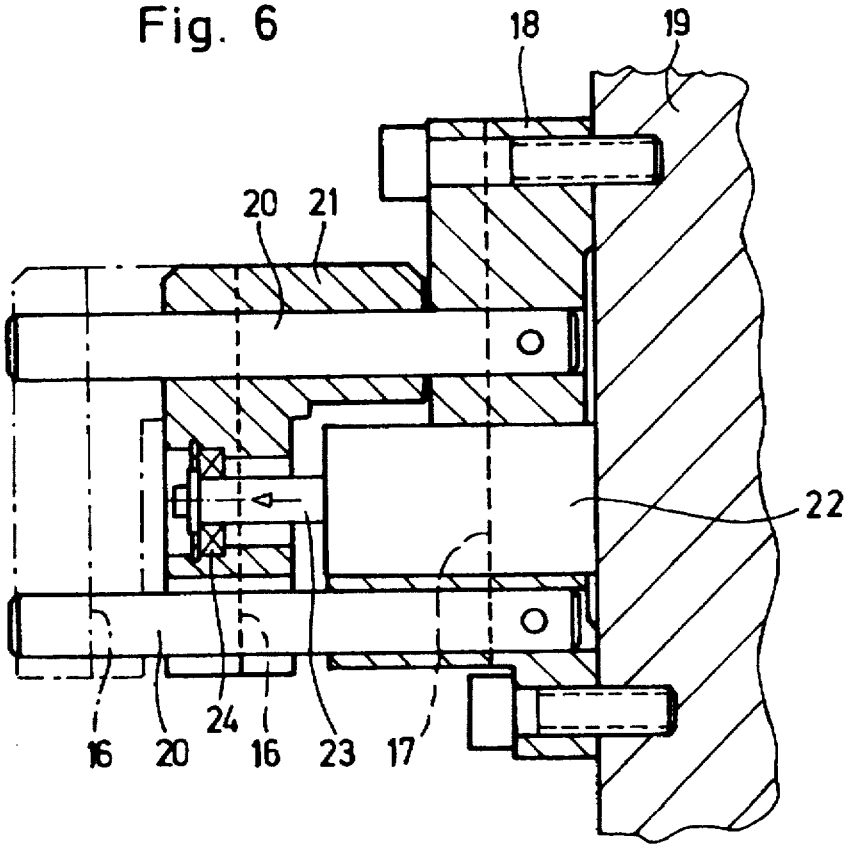
FIG. 6 shows the mounting of the two tread surfaces.

It should be appreciated that, in accordance with at least one preferred embodiment of the present invention, the arrangement described and illustrated herein with respect to FIGS. 3 and 4 may be utilized in conjunction with the arrangement described and illustrated herein with reference to FIGS. 5–7. In other words, it is conceivable to mount roller 14 on a flange 15 in such a manner that permits selective variation of eccentricity e, while also permitting variation of the distance between tread surfaces 16, 17. In this manner, a predetermined, constant eccentricity e can be preset for a given printing run, while allowing for further adjustments to be made to the stroke of the distributor roller during the printing run, via variation of the distance between tread surfaces 16 and 17.

Conceivably, any suitable arrangement may be utilized for permitting selective variation of eccentricity e as illustrated in FIG. 4. For example, flange 15 could conceivably be provided with a groove configured for accommodating at least a portion of roller pin 13, along with an arrangement for selectively fixing roller pin 13 with respect to such a grove. Such a groove can conceivably have an orientation that permits selective variation of eccentricity e over a variety of values. Thus, such a groove could conceivably run along a diameter of flange 15. Other types of arrangements for selectively varying the eccentricity e of a roller 14 with respect to a crank pin 10 are, of course, conceivable within the scope of the present invention and are not meant to be restricted to the arrangement just described.

Preferably, in accordance with at least one preferred embodiment of the present invention, the aforementioned tread surfaces 16, 17 will preferably be oriented in a vertical direction with respect to the printing unit in question.

The principle illustrated in FIG. 7, relating to the effect of the variation of the distance between tread surfaces 16 and 17 on the stroke of the distributor roller in question, can be better understood when realizing that the stroke will essentially be inversely proportional to the distance between tread surfaces 16 and 17. It will thus be appreciated that an increased distance between tread surfaces 16 and 17 will result in greater freedom of horizontal movement for roller 14, and that this, in turn, will result in decreased lateral movement of worm gear 4 and, consequently, worm 3 (see FIGS. 3 and 4). Essentially, inasmuch the arrangement illustrated in the right half of FIG. 7 will result in a maximum stroke equivalent to twice the eccentricity e (hereinafter "2e"), any separation of tread surfaces 16 and 17 apart from one another over and above an amount equivalent to 2e plus the diameter (hereinafter "D") of roller 14, will result in a stroke that is less than the maximum stroke of 2e by an amount essentially equal to the degree of separation of tread surfaces 16 and 17 beyond the value of "2e+D" (i.e. twice the eccentricity plus the diameter of roller 14). Thus, it can be said that, if tread surfaces 16 and 17 happen to be separated by a distance approximately equivalent to (2e+D), there will essentially be no axial stroke of the distributor roller in question as a result. It is essentially in this manner that the arrangement shown in the left half of FIG. 7 in which the tread surfaces 16 and 17 are separated by a distance approximately equivalent to (2e+D−1 mm), will result in an axial stroke of 1 mm of the distributor roller in question.

The phenomenon that governs the relationship between the separation of tread surfaces 16 and 17 and the resulting axial stroke of the distributor roller in question may be visualized in terms of the degree to which distributor roller 14 is forced against either of the tread surfaces 16 and 17. At one extreme, when the tread surfaces 16 and 17 are separated by a distance equivalent to (2e+D) or greater, roller 14 will essentially come into minimal, if any, contact with tread surfaces 16 and 17. In the absence of such contact, roller 14 will essentially not be restricted against horizontal movement. Thus, during rotation of worm gear 4 and crank pin 10, roller 14 will avoid interaction with either of tread surfaces 16 and 17 in a manner that would otherwise force roller 14 to discontinue its horizontal movement.

On the other hand, if the separation between tread surfaces 16 and 17 is less than (2e+D), then roller 14 will indeed, to some degree, contact the tread surfaces 16 and 17. Particularly, depending on the separation of tread surfaces 16 and 17, the roller 14, while attempting to revolve about the central rotational axis of crank pin 10, will at some point be hindered, either by tread surface 16 or tread surface 17, from undergoing the horizontal component of its revolutionary movement, thus forcing it only to undergo a vertical translational movement, parallel to the tread surfaces 16 and 17. However, the result will preferably be a horizontal force component generated between roller 14 and the tread surface 16 or 17 in question, and since the roller 14 is restricted any further horizontal translational movement, this horizontal force component will be transmitted in such a manner as to result in the lateral displacement of worm 3 (see FIGS. 3 and 4). In the extreme case in which tread surfaces 16 and 17 are only separated by a distance corresponding to the diameter of roller 14, roller 14 will essentially never undergo any horizontal translational displacement and will instead be restricted to strictly vertical displacement, parallel to tread surfaces 16 and 17. This would then essentially result in a virtually continuous transfer of the aforementioned horizontal force component in such a manner so as to virtually continuously displace worm 3, save for the brief movements of changeover from axial displacement of worm 3 (and consequently also the stub axle 1 and the distributor roller in question) in a first axial direction to movement in a second, opposite axial direction.

Figure 6A:
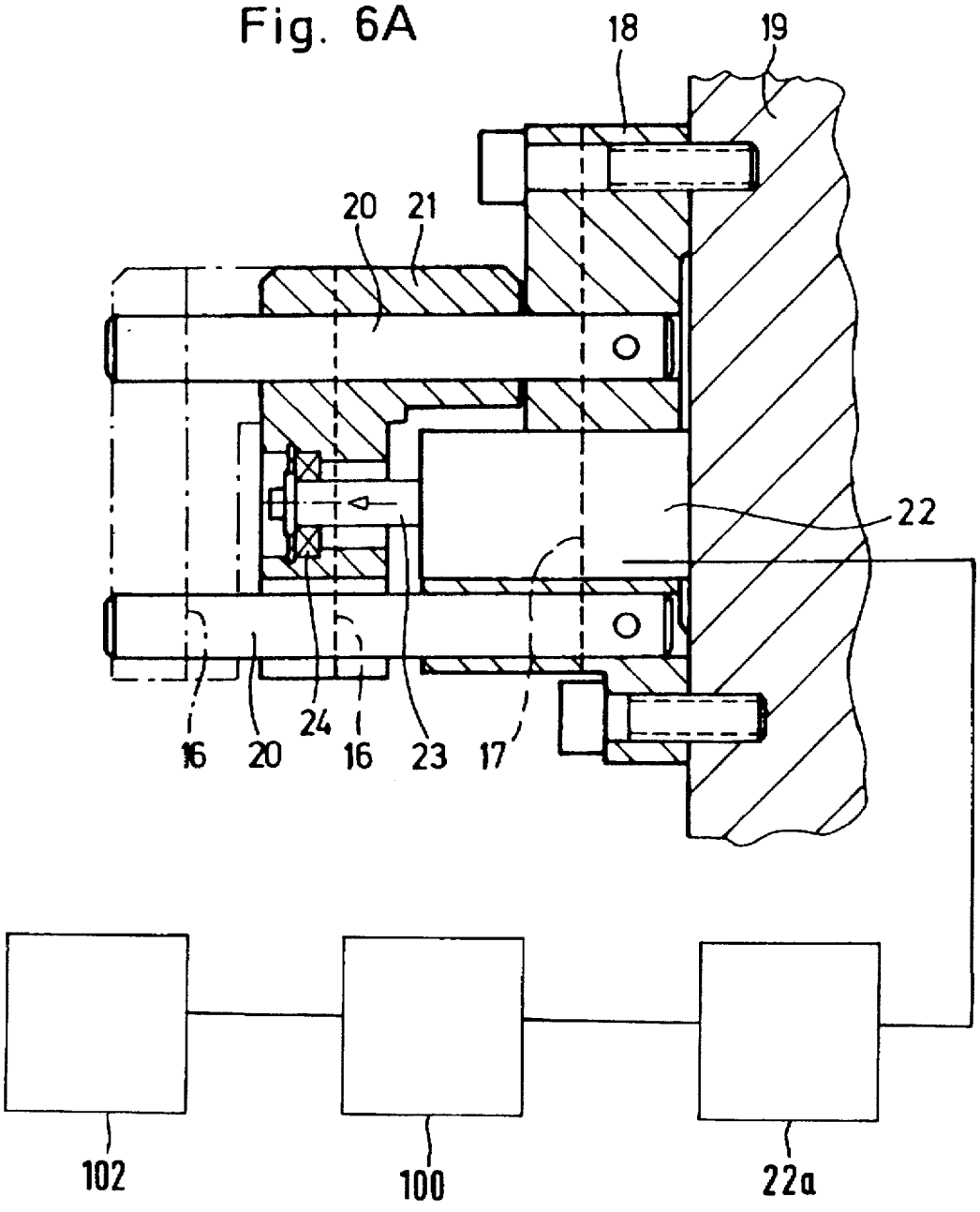
FIGS. 6A and 6B are essentially the same view as FIG. 6, but show additional components.

FIG. 6A illustrates a control arrangement 22*a* that may be utilized in conjunction with actuator 22. In accordance with a preferred embodiment of the present invention, this control arrangement 22*a* may itself be in communication with another control arrangement 100, which control arrangement 100 may be designated for the purpose of establishing and changing ink profiles at an ink duct 102. Thus, it is conceivable to automatically link control of actuator 22 with the establishment of ink profiles, thereby allowing the axial stroke of the distributor roller in question to be established as a function of any ink profile that may be used. In this respect, it is conceivable to determine the stroke of the distributor roller in question, as governed by the separation between tread surfaces 16 and 17, in response to predetermined parameters, relating to the lay of given ink profiles, that may be preprogrammed into either or both of the control arrangements 22*a* and 100. For example, it is conceivable to preprogram control arrangement 22*a* in such a manner that, given an ink profile input into control arrangement 100 that involves a particularly sharp change between two zones, a minimal, if any, axial stroke movement of the distributor roller in question will result. Criteria for quantitatively assessing the overall interzonal varying of a given ink profile can also conceivably be preprogrammed.

Figure 6B:
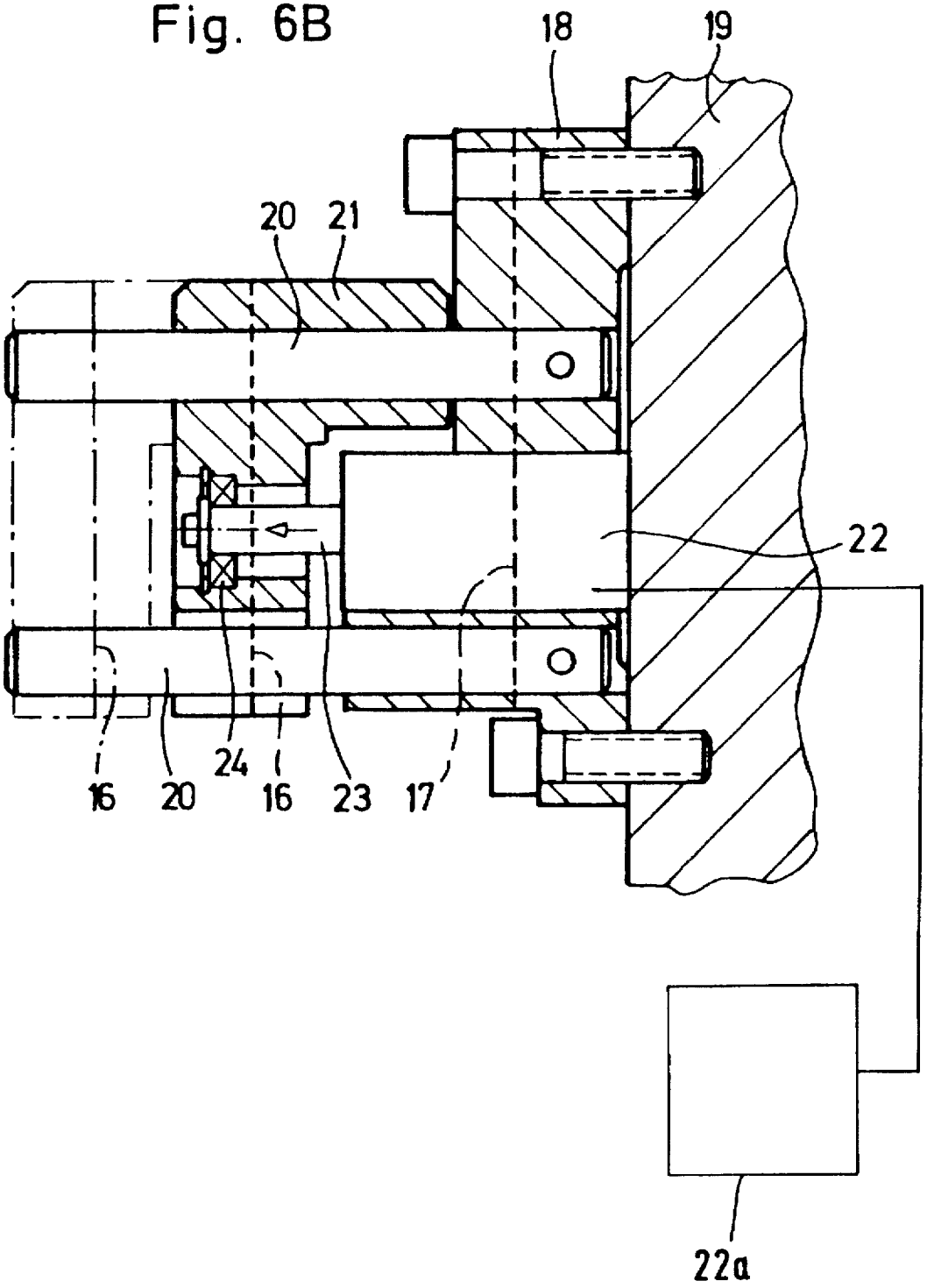

Alternatively, it is conceivable for control arrangement 22*a* to be independent, as illustrated in FIG. 6B. In this case, it is conceivable to manually input a desired parameter or parameters, for the purpose of governing the action of actuator 22, depending on the desired printing characteristics, as determined by the press operator. Of course, the automatic arrangement described with reference to FIG. 6A could conceivably be provided with a manual override.

It will be appreciated, then, that in accordance with at least one preferred embodiment of the present invention, the stroke of the distributor roller in question can be changed even while the printing unit is in operation. This could conceivably be accomplished by an automatic arrangement such as that shown in FIG. 6A, or even by a manual arrangement such as that shown in FIG. 6B. In either case, the result will be a change in the distance between tread surfaces 16 and 17, as governed by actuator 22, whether the change is undertaken by automatic or manual controls. Accordingly, it would not be necessary to stop the printing press or printing unit in order to make the desired adjustments. Of course, when the printing press is not in operation, it is still conceivable that such adjustments could be made at that time, as well as any desired adjustment to the eccentricity e, as illustrated in FIG. 4. However, in accordance with at least one preferred embodiment of the present invention, it will essentially be possible to selectively vary the stroke of the,distributor roller in question, whether automatically or manually, even once an essentially constant eccentricity e of roller 14 has already been established.

Figure 8:
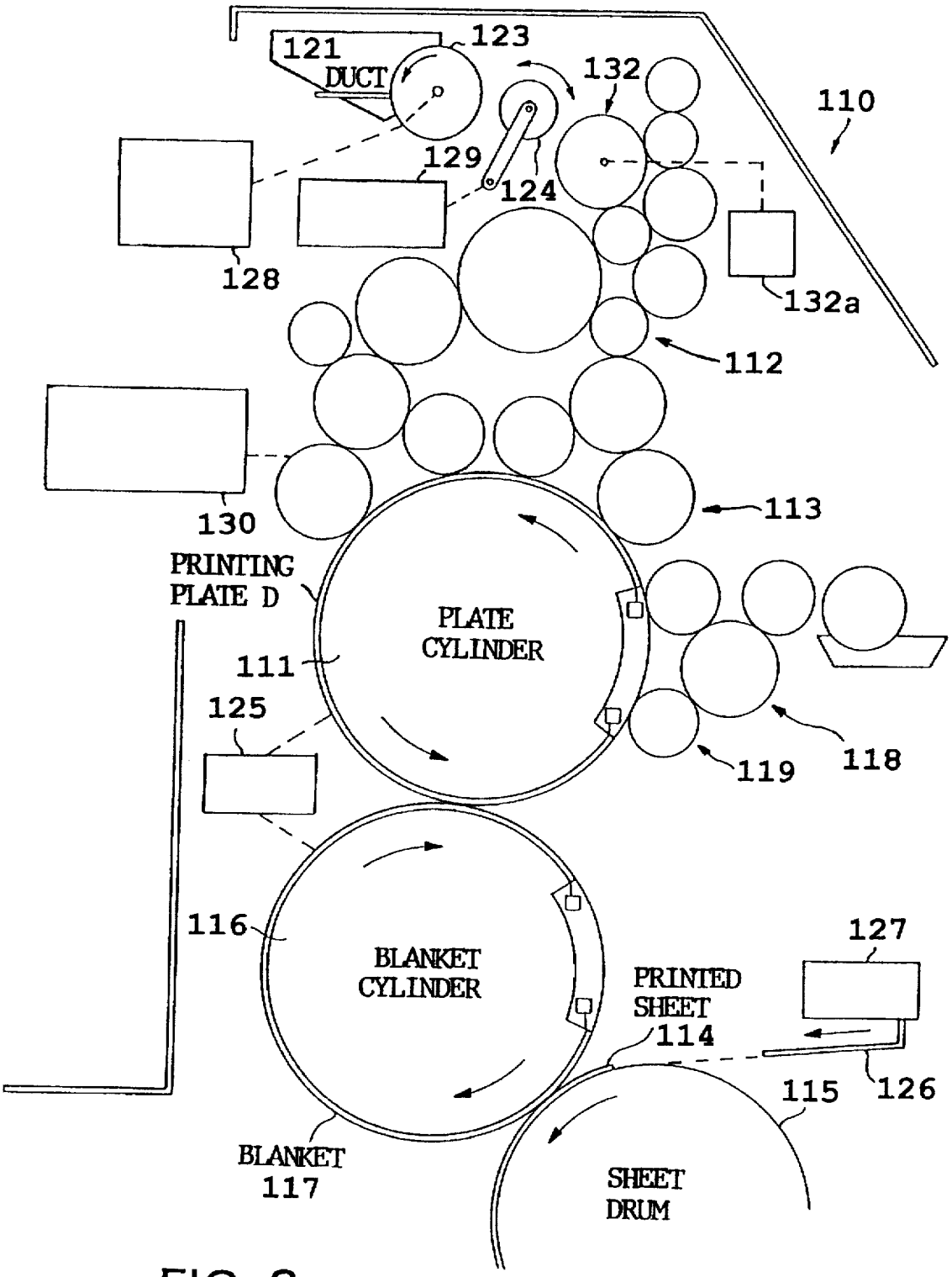
FIG. 8 illustrates a print stand, or printing unit, of a rotary printing press.

FIG. 8 illustrates a rotary print stand 110 of a rotary printing press which can employ a distributor roller displacement arrangement according to the present invention. Rotary print stand 110 generally includes: a plate cylinder 111 for having mounted thereon a printing plate D; an inking unit 112 which includes ink applicator rollers 113 for applying ink to the printing plate an ink profile; a dampening (or wetting) unit 118 having dampening applicator rollers 119 for transferring a dampening agent to the printing plate D, a blanket cylinder 116 carrying a rubber blanket 117 for receiving an ink impression from the printing plate D, and a sheet drum 115 for carrying a printed sheet 114 onto which the ink impression carried by blanket 117 is transferred. A duct roller 123 is typically mounted adjacent to ink duct 121. Typically, ink is transferred from duct roller 123 to inking unit 112 by means of a vibrator roller 124 which oscillates to successively pick up ink from duct roller 123 and deposit the same on a roller 132 of inking unit 112. Typically, the printing stand 110 will also include auxiliary mechanisms such as, for example, a duct roller drive 128, a vibrator roller drive 129, an applicator roller throw-off 227 for lifting the ink applicator rollers 113 off of the printing plate, a press drive 125 and a sheet feed 127 for supplying the sheets to be printed 126 to sheet drum 115.

With relation to FIG. 8, roller 132 may be a distributor roller having an arrangement for displacing the same, indicated at 132*a*, such as has been described heretofore with relation to FIGS. 1–7.

One feature of the invention resides broadly in the method for resetting an inking mechanism of printing machines, in which there are areas on an ink duct roller, in a direction at right angles to the direction of printing, which have ink layers of different thickness, and which are applied to a printing form by means of a number of inking unit rollers and inking rollers, corresponding to the ink requirements of the individual zones, and in which the inking unit rollers are designed as distributing rollers which move axially and which periodically execute an axial stroke, characterized by the fact that when the printed items being produced have a relatively uniform ink profile, seen in the direction at right angles to the direction of printing, the distributing rollers are set to the respective specified full stroke, and that when printed items are being produced which have an ink profile which differs significantly from one zone to another in the direction at right angles to the direction of printing or when there is a brief interruption of the printing, the stroke of at least the first distributing roller which follows the ink duct roller, as the printing unit continues to run, is reset to a lower value near 0.

Another feature of the invention resides broadly in the apparatus for the realization of the method characterized by the fact that the axial stroke of the distributing roller takes place by means of a roller 14 which is eccentrically e offset on the stub axle 1 of the distributing roller, which roller 14 can be moved between two tread surfaces 16, 17 mounted in parallel to one another on the machine side frame 19, that the roller 14 has a rotational drive so that its eccentric position e moves the distributing roller axially back and forth, and that the distance b of at least one of the two parallel tread surfaces 16, 17 with respect to the other tread can be increased to a.

Yet another feature of the invention resides broadly in the apparatus characterized by the fact that one tread surface 16 is provided on a sliding body 21 which is mounted so that it can be moved by means of an actuator 22 on bearing pins 20, whereby the opposite tread surface 17 is provided on a carrier 18 which is fastened to the machine side frame 19.

Examples of printing presses, which may be utilized in accordance with the embodiments of the present invention, may be found in the following U.S. Pat. No. 5,170,706, which issued to Rodi et al. on Dec. 15, 1992; U.S. Pat. No. 5,081,926, which issued to Rodi on Jan. 21, 1992; and U.S. Pat. No. 5,010,820, which issued to Löffler on Apr. 30, 1991.

Examples of general concepts and principles relating to the establishment of ink zone profiles in printing presses may be found in the following U.S. Pat. No. 5,174,210, which issued to Rodi et al. on Dec. 29, 1992; U.S. Pat. No. 5,081,926, which issued to Rodi on Jan. 21, 1992; and U.S. Pat. No. 5,010,820, which issued to Löffler on Apr. 30, 1991.

In recapitulation, the present invention can generally relate to a method and an apparatus for resetting an inking unit of printing machines, in which on an ink duct roller, seen at right angles to the direction of printing, there are areas with different thicknesses of the ink layers which are applied to a printing form by means of a number of ink duct rollers and inking rollers, the different thicknesses corresponding to the specified zonal requirement for ink, and in which inking rollers are designed as distributor rollers which move axially and periodically execute an axial stroke, movement, or displacement.

In further recapitulation, there is disclosed herein a method and an apparatus to reset an inking mechanism on printing machines, in which there are areas on an ink duct or fountain roller, seen at right angles in relation to the direction of printing, which have different thicknesses of ink layers, and which are applied to a printing form by means of a number of inking unit rollers and inking rollers as required in the individual zones, and with distributing rollers which periodically execute an axial stroke, and the stroke of which can be set to affect the lateral flow of the ink.

The appended drawings in their entirety, including all dimensions, proportions and/or shapes in at least one embodiment of the invention, are accurate and to scale and are hereby included by reference into this specification.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 44 35 991.8, filed on Oct. 8, 1994, having inventors Dr. Norbert Thunker and Rudi Junghans, and DE-OS P 44 35 991.8 and DE-PS P 44 35 991.8, are hereby incorporated by reference as if set forth in their entirety herein.

The invention as described hereinabove in the context of the preferred embodiments is not to be taken as limited to all of the provided details thereof, since modifications and variations thereof may be made without departing from the spirit and scope of the invention.

What is claimed is:

1. A method for printing items of a print job in a rotary printing press, a print job being the transfer of ink from the rotary printing press to a series of individual items to be identically printed, the rotary printing press comprising at least one distributor roller having an axis of rotation, said at least one distributor roller being movable in a direction substantially parallel to the axis of rotation over a lateral stroke, said method comprising the steps of:

determining an ink profile for the items to be printed on in a print job of individual items to be identically printed;

determining an ink profile stroke of said at least one distributor roller for printing the print job of individual items to be identically printed based on the determined ink profile for printing;

determining a minimal stroke of said at least one distributor roller to minimize the lateral spreading of ink on said at least one distributor roller upon an interruption of items being fed in the print job of individual items to be identically printed;

establishing the ink profile for the items to be printed on in the print job of individual items to be identically printed on said at least one distributor roller;

providing the items to be printed on in the print job of individual items to be identically printed;

feeding the items to be printed on to the rotary printing press to print in the print job of individual items to be identically printed;

stroking said at least one distributor roller at the determined ink profile stroke;

printing on the items being fed in the print job of individual items to be identically printed;

interrupting the feeding of items to be printed on in the print job of individual items to be identically printed prior to the completion of printing of all of the items to be printed on in the print job of individual items to be identically printed while the printing press continues to run and said at least one distributor roller continues to rotate;

automatically changing the stroke of said at least one distributor roller from the determined ink profile stroke for printing to the minimal stroke during an interruption of feeding of items to be printed on in the print job of individual items to be identically printed thus minimizing the lateral spreading of ink on said at least one distributor roller;

resuming the feeding of items to be printed on in the print job of individual items to be identically printed; and automatically changing the stroke of said at least one distributor roller from the minimal stroke to the determined ink profile stroke for printing upon a resumption of the feeding of items to be printed on in the print job of individual items to be identically printed.

2. The method according to claim 1, wherein said step of determining a minimal stroke of said at least one distributor roller comprises determining a stroke of said at least one distributor roller substantially less than a maximal stroke of said at least one distributor roller.

3. The method according to claim 2, wherein said step of determining an ink profile stroke of said at least one distributor roller comprises determining a plurality of ink layer thicknesses for the determined ink profile for the items to be printed.

4. The method according to claim 3, wherein the ink profile for the items to be printed comprises a plurality of ink profile zones, each of said ink profile zones comprising a width dimension extending substantially parallel to the axis of rotation of said at least one distributor roller, and further wherein:

said step of determining an ink profile stroke of said at least one distributor roller comprises determining the maximal stroke of said at least one distributor roller based upon the determination of the plurality of ink layer thicknesses for the determined ink profile for the items to be printed;

said step of determining a plurality of ink layer thicknesses for the determined ink profile for the items to be printed comprises determining an individual ink layer thickness for each one of said plurality of ink profile zones; and said step of determining the maximal stroke based upon the determination of the plurality of ink layer thicknesses for the determined ink profile for the items to be printed comprises determining the maximal stroke based upon a determination that the determined individual ink layer thicknesses of at least two neighboring ink profile zones are substantially equal to one another.

5. The method according to claim 4, wherein said step of interrupting the feeding of items to be printed on in the print job comprises interrupting the feeding of items to be printed on in the print job of individual items to be identically printed for a period of time substantially less than the period of time required for the printing on of all of the items to be printed on in the print job of individual items to be identically printed.

6. The method according to claim 5, wherein the rotary printing press further comprises at least one ink duct roller, and further wherein said at least one distributor roller is disposed to be the first distributor roller to receive ink from said at least one ink duct roller for transfer of the received ink to the items to be be printed on in the print job.

7. The method according to claim 3, wherein an ink profile for the items to be printed comprises a plurality of ink profile zones, each of said ink profile zones comprising a width dimension extending substantially parallel to the axis of rotation of said at least one distributor roller, and further wherein:

said step of determining an ink profile stroke of said at least one distributor roller comprises determining the minimal stroke of said at least one distributor roller based upon the determination of the plurality of ink layer thicknesses for the determined ink profile for the items to be printed;

said step of determining a plurality of ink layer thicknesses for the determined ink profile for the items to be printed comprises determining an individual ink layer thickness for each one of said plurality of ink profile zones; and said step of determining the minimal stroke based upon the determination of the plurality of ink layer thicknesses for the determined ink profile comprises determining the minimal stroke based upon a determination that the determined individual ink layer thicknesses of least two neighboring ink profile zones are substantially different from one another.

8. The method according to claim 7, wherein said step of interrupting the feeding of items to be printed on in the print job comprises interrupting the feeding of items to be printed on in the print job of individual items to be identically printed for a period of time substantially less than the period of time required for the printing on of all of the items to be printed on in the print job of individual items to be identically printed.

9. The method according to claim 8, wherein the rotary printing press further comprises at least one ink duct roller, and further wherein said at least one distributor roller is disposed to be the first distributor roller to receive ink from said at least one ink duct roller for transfer of the received ink to the items to be be printed on in the print job.

10. The method according to claim 1, wherein said step of interrupting the feeding of items to be printed on in the print job comprises interrupting the feeding of items to be printed on in the print job of individual items to be identically printed for a period of time substantially less than the period of time required for the printing on of all of the items to be printed on in the print job of individual items to be identically printed.

11. Device to axially reciprocate at least one distributor roller of a rotary printing press, said device for automatically changing the stroke length of at least one distributor roller of a rotary printing press between a printing stroke and an interrupt stroke during a print job, a print job being the transfer of ink from a rotary printing press to a series of individual items to be identically printed, said device comprising:

adjusting apparatus to adjust the stroke length of the axial reciprocation of at least one distributor roller by said device between a maximum stroke and a minimum stroke;

setting apparatus to set the stroke length of said adjusting apparatus;

said setting apparatus comprising:

apparatus to set a printing stroke for axially reciprocating at least one distributor roller at a first stroke length during printing on the items of a print job; and apparatus to set an interrupt stroke for axially reciprocating at least one distributor roller at a second stroke length during an interruption of printing on the items of a print job prior to the completion of printing on all the individual items of a print job to minimize the lateral spreading of ink on at least one distributor roller upon an interruption of printing on the items of a print job; and apparatus to automatically change the stroke from the printing stroke to the interrupt stroke upon an interruption of printing in a print job prior to the completion of printing of all of the items to be printed on in a print job upon the printing press continuing to run and at least one distributor roller continuing to rotate, and to automatically change the stroke from the interrupt stroke to the printing stroke upon a resumption of printing of the remaining items to be printed on in a print job.

12. The device according to claim 11, further comprising:

a rotary drive to convert at least a portion of a rotary motion of at least one distributor roller of a rotary printing press to a lateral motion of at least one distributor roller of a rotary printing press; and said rotary drive being configured and disposed to be non-rotatably connected to at least one distributor roller of a rotary printing press.

13. The device according to claim 12, wherein said rotary drive comprises:

an input member;

said input member is configured to be non-rotatably connected to a stub axle of at least one distributor roller of a rotary printing press to be rotatingly driven by rotation of at least one distributor roller of a rotary printing press;

an output member;

said output member is operatively connected to said input member to revolve about an axis of revolution upon rotation of said input member; and said output member is disposed a distance from the axis of revolution.

14. The device according to claim 13, wherein:

said output member comprises a roller;

said roller has a diameter;

said adjusting apparatus comprises a first tread surface and a second tread surface;

both of said first and second tread surfaces are configured to be mounted on a side frame of a rotary printing press;

said first and second tread surfaces are disposed substantially parallel to one another;

said first and second tread surfaces are spaced apart from one another;

said roller is disposed between said first and second tread surfaces to be movable between said first and second tread surfaces; and said adjusting apparatus further comprises an arrangement to adjust the separation between said first and second tread surfaces to adjust the lateral stroke of said device.

15. The device according to claim 14, wherein:

the distance said output member is disposed from the axis of revolution represents the eccentricity of said rotary drive; and said arrangement to adjust the separation between said first and second tread surfaces comprises an arrangement to adjust the separation between said first and second tread surfaces between:

a minimum separation distance substantially equivalent to the diameter of said roller; and a maximum separation distance substantially equivalent to the diameter of said roller plus twice the eccentricity of said rotary drive.

16. The device according to claim 15, wherein:

said arrangement to adjust the separation distance between said first and second tread surfaces between a minimum separation distance and a maximum separation distance comprises a carrier;

said carrier is configured to be fixedly fastened to a side frame of a rotary printing press;

said carrier comprises said first tread surface;

said arrangement to adjust the separation distance between said first and second tread surfaces between a minimum separation distance and a maximum separation distance comprises a sliding body;

said sliding body comprises said second tread surface;

said arrangement to adjust the separation between said first and second tread surfaces comprises a plurality of bearing pins;

said sliding body is slidably mounted on said plurality of bearing pins;

said setting apparatus to set the stroke length of said adjusting apparatus comprises an actuator to set the separation distance between said first and second tread surfaces; and said actuator is operatively connected to said sliding body to slide said sliding body along said bearing pins to set the separation distance between said first and second tread surfaces.

17. The device according to claim 16, wherein:

said input member of said rotary drive comprises a worm;

said worm is configured to be disposed substantially coaxially with a stub axle of at least one distributor roller of a rotary printing press;

said rotary drive further comprises:

a worm gear;

said worm gear is in mesh with said worm;

said worm gear is disposed to rotate about the axis of revolution of said roller;

a rotatable portion attached to said worm gear;

said rotatable portion is disposed to rotate about the axis of revolution of said roller; and said roller is attached to said rotatable portion to revolve said roller about the axis of revolution.

18. The device according to claim 17, wherein:

said apparatus to automatically change the stroke comprises a control arrangement to automatically control the change of stroke from the printing stroke to the interrupt stroke upon an interruption of printing in a print job prior to the completion of printing of all of the items to be printed on in a print job, and to automatically control the change of stroke from the interrupt stroke to the printing stroke upon a resumption of printing of the remaining items to be printed on in a print job; and said control arrangement is operatively connected to said actuator to set the distance between said first and second tread surfaces to:

the distance corresponding to the interrupt stroke for changing from the printing stroke to the interrupt stroke; and the distance corresponding to the printing stroke for changing from the interrupt stroke to the printing stroke.

19. A method for printing items of a print job in a rotary printing press, a print job being the transfer of ink from the rotary printing press to a series of individual items to be identically printed, the rotary printing press comprising at least one distributor roller having an axis of rotation, said at least one distributor roller being movable in a direction substantially parallel to the axis of rotation over a lateral stroke, said method comprising the steps of:

determining an ink profile for the items to be printed on in a print job of individual items to be identically printed;

determining an ink profile stroke of said at least one distributor roller for printing the print job of individual items to be identically printed based on the determined ink profile for printing;

determining a minimal stroke of said at least one distributor roller to minimize the lateral spreading of ink on said at least one distributor roller upon an interruption of items being fed in the print job of individual items to be identically printed;

establishing the ink profile for the items to be printed on in the print job of individual items to be identically printed on said at least one distributor roller;

providing the items to be printed on in the print job of individual items to be identically printed;

feeding the items to be printed on to the rotary printing press to print in the print job of individual items to be identically printed;

stroking said at least one distributor roller at the determined ink profile stroke;

printing on the items being fed in the print job of individual items to be identically printed;

interrupting the feeding of items to be printed on in the print job of individual items to be identically printed prior to the completion of printing of all of the items to be printed on in the print job of individual items to be identically printed while the printing press continues to run and said at least one distributor roller continues to rotate;

changing the stroke of said at least one distributor roller from the determined ink profile stroke for printing to the minimal stroke during an interruption of feeding of items to be printed on in the print job of individual items to be identically printed thus minimizing the lateral spreading of ink on said at least one distributor roller;

resuming the feeding of items to be printed on in the print job of individual items to be identically printed; and changing the stroke of said at least one distributor roller from the minimal stroke to the determined ink profile stroke for printing upon a resumption of the feeding of items to be printed on in the print job of individual items to be identically printed.

20. The method according to claim 19, wherein an ink profile for the items to be printed comprises a plurality of ink profile zones, each of said ink profile zones comprising a width dimension extending substantially parallel to the axis of rotation of said at least one distributor roller, and wherein the rotary printing press further comprises at least one ink duct roller, and further wherein:

said step of determining a minimal stroke of said at least one distributor roller comprises determining a stroke of said at least one distributor roller substantially less than a maximal stroke of said at least one distributor roller;

said step of determining an ink profile stroke for the items to be printed on in a print job comprises determining a plurality of ink layer thicknesses for the determined ink profile for the items to be printed;

said step of determining a plurality of ink layer thicknesses comprises determining an individual ink layer thickness for each one of said plurality of ink profile zones;

said step of determining an ink profile stroke for the items to be printed on in a print job further comprises one of:

determining the maximal stroke of said at least one distributor roller based upon a determination that the determined individual ink layer thicknesses of at least two neighboring ink profile zones are substantially equal to one another; and determining the minimal stroke of said at least one distributor roller based upon a determination that the determined individual ink layer thicknesses of at least two neighboring ink profile zones are substantially different from one another;

said step of interrupting the feeding of items to be printed on in the print job comprises interrupting the feeding of items to be printed on in the print job of individual items to be identically printed for a period of time substantially less than the period of time required for the printing on all of the items to be printed on in the print job of individual items to be identically printed; and said at least one distributor roller is disposed to be the first distributor roller to receive ink from said at least one ink duct roller for transfer of the received ink to the items to be printed on in the print job.

* * * * *